US007644994B2

(12) United States Patent
Busley et al.

(10) Patent No.: US 7,644,994 B2
(45) Date of Patent: Jan. 12, 2010

(54) CONSTRUCTION MACHINE FOR MACHINING FLOOR SURFACES

(75) Inventors: Peter Busley, Linz (DE); Olaf Gaertner, Linz (DE); Dieter Simons, Buchholz (DE)

(73) Assignee: Wirtgen GmbH (DE)

( * ) Notice: Subject to any disclaimer, the term of this patent is extended or adjusted under 35 U.S.C. 154(b) by 896 days.

(21) Appl. No.: 10/312,622

(22) PCT Filed: May 10, 2001

(86) PCT No.: PCT/EP01/05337

§ 371 (c)(1),
(2), (4) Date: Jul. 30, 2003

(87) PCT Pub. No.: WO02/01005

PCT Pub. Date: Jan. 3, 2002

(65) Prior Publication Data

US 2004/0021364 A1 Feb. 5, 2004

(30) Foreign Application Priority Data

Jun. 27, 2000 (DE) ..... 100 31 195

(51) Int. Cl.
*E01C 23/88* (2006.01)

(52) U.S. Cl. ..... 299/39.4; 299/95

(58) Field of Classification Search ..... 299/95, 299/39.4–39.8; 474/58, 59

See application file for complete search history.

(56) References Cited

U.S. PATENT DOCUMENTS 4,139,318 A 2/1979 Jakob et al.
4,325,580 A * 4/1982 Swisher et al. ..... 299/39.8
4,655,634 A 4/1987 Loy et al.
4,929,121 A 5/1990 Lent et al.

(Continued)

FOREIGN PATENT DOCUMENTS

DE 4022034 A1 1/1992

(Continued)

OTHER PUBLICATIONS

Exhibit A: Translation of Opposition re German Patent DE 10031195.4, (13 pages) dated Apr. 10, 2002.

(Continued)

*Primary Examiner*—John Kreck
(74) *Attorney, Agent, or Firm*—Waddey & Patterson, P.C.; Lucian Wayne Beavers

(57) ABSTRACT

In a construction machine 1 for the treatment of ground surfaces, comprising a chassis 2 carrying a machine frame 4, a drive motor 6, a work drum 8 supported on the machine frame 4 and having exchangeable tools 14 fastened to its outer surface 12, and a drive line 18 for the work drum 8 comprising at least the drive motor 6 and a transmission coupled to the drive motor 6, it is provided that an auxiliary drive 20, adapted to be coupled to the drive line 18, is arranged to rotate the work drum 8 in the raised condition of the drum by a predetermined or selectable rotational angle, the torque of the auxiliary drive 20 being higher than the moment of inertia of the work drum 8 and of the drive line 18 in the switched-off or decoupled state of the drive motor 6.

34 Claims, 7 Drawing Sheets

U.S. PATENT DOCUMENTS

| | | | |
|---|---|---|---|
| 5,186,575 | A | 2/1993 | Wirtgen |
| 5,297,894 | A | 3/1994 | Yenick |
| 5,527,218 | A | 6/1996 | Van den Bossche et al. |

FOREIGN PATENT DOCUMENTS

| | | | |
|---|---|---|---|
| DE | 29611169 | U1 | 10/1996 |
| EP | 0986946 | B1 | 4/2004 |

OTHER PUBLICATIONS

Exhibit B: First enclosure to Appendix PPU1 to Exhibit A, photograph (1 page) (undated).
Exhibit C: Second enclosure to Appendix PPU1 to Exhibit A - CAT PM-565 brochure (8 pages) (dated Dec. 1992).
Exhibit D: Third enclosure to Appendix PPU1 to Exhibit A - drawing (1 page) (undated).
Exhibit E: Fourth enclosure to Appendix PPU1 to Exhibit A - drawing (1 page) (undated).
Exhibit F: Fifth enclosure to Appendix PPU1 to Exhibit A - drawing (1 page) (undated).
Exhibit G: Sixth enclosure to Appendix PPU1 to Exhibit A - Product Training Bulletin PM-565 Cold Planer (3 pages) (dated Jan. 1993).
Exhibit H: First enclosure to Appendix PPU2 to Exhibit A - drawing (1 page) (undated).
Exhibit I: Second enclosure to Appendix PPU2 to Exhibit A - Used Equipment advertisement (3 pages) (undated).
Exhibit J: CAT PR-750B Pavement Profiler brochure (10 pages) (dated Feb. 1987).
Exhibit K: Translation of Response to Opposition re German Patent DE 10031195.4, dated Dec. 28, 2004 (11 pages).
Exhibit L: Translation of Reply to Response to Opposition re German Patent DE 10031195.4, dated Feb. 28, 2005 (4 pages).
Exhibit M: Opposition Submission re European Patent No. EP 1294991 (Application No. 01929639.1) dated Apr. 12, 2007 (13 pages).
Exhibit N: Response to Opposition Submission re European Patent No. EP 1294991, dated Sept. 6, 2007.

* cited by examiner

CONSTRUCTION MACHINE FOR MACHINING FLOOR SURFACES

BACKGROUND OF THE INVENTION

The invention relates to a construction machine for the treatment of ground surfaces.

Construction machines of this type, e.g. large-sized milling devices or cold milling devices, comprise a machine frame having supported therein a milling drum extending transversely to the moving path to be treated. The machine frame further accommodates the milling-drum drive unit and is supported, in a manner allowing for height adjustment, by a plurality of truck assemblies arranged before and behind the milling drum.

Such large-sized milling device and cold milling devices, or recyclers, are used for the milling of road surfaces, e.g. on highways or country roads. The milling drums have their outer surfaces equipped with exchangeable tools. In case of extremely hard road surfaces, it may happen that the tools have a service life as brief as only half an hour and that all of the tools of the milling drum have to be replaced thereafter. For this purpose, the chassis or the milling drum is arranged to be lifted until the milling drum is not in contact with the ground surface anymore. After swinging away a housing member of the roller housing, an operating person can perform the exchanging of the tools. In such construction machines with mechanical drive, the milling drum has to be rotated from time to time to allow the exchange of the tools. This rotation can be carried out by hand, which, however, requires considerable forces. It is also known to rotate the work or milling drum by means of a hand-operated crank, with the crank being coupled to a reduction gear of the milling drum. Since the crank can be arranged only on the outer side of the machine, the tool-exchanging process will ultimately require two operating persons.

Rotating the work or milling drum by use of the drive motor is excluded for safety reasons. Besides, the work roller is to be advanced only by a small rotational angle so that the next row of tools can be exchanged.

SUMMARY OF THE INVENTION

It is an object of the invention to improve a construction machine of the initially mentioned type in such a manner that an exchange of the tools can be performed with reduced expenditure in personnel and time and with a reduced risk of accidents.

According to the invention, it is advantageously provided that an auxiliary drive can be coupled to the drive line to rotate the work roller in its raised condition by a predetermined or selectable rotational angle, the torque of the auxiliary drive being higher than the moment of inertia of the work roller and of that part of the drive line which is moved along with the work roller.

The auxiliary drive, each time it is actuated, will rotate the work roller by a small rotational angle to bring not yet exchanged tools into a more convenient mounting position. The torque of the auxiliary drive is slightly higher than the moment of inertia of the work roller and of the drive line moving along with the latter, thus allowing a rotational movement while keeping the risk of accidents as low as possible. During this period, the drive motor for the work roller is out of operation or decoupled.

The invention makes it advantageously possible to reduce the required time for the exchange of tools because the auxiliary drive can be actuated by the operating person at the site of work roller. The feature that the auxiliary drive will drive the work roller with low power, nearly completely excludes the danger of accidents caused by the possibility that parts of the clothes of the operating person might get caught in the tools of the work roller during rotation of the latter. Since the torque of the auxiliary drive is just high enough to allow for a rotational movement of the work roller with about 3 rpm, the motor of the auxiliary drive can be quickly stopped in case that higher forces should occur on the work roller. Further, the auxiliary drive is arranged to stop automatically after about 4 seconds subsequent to each activation.

Preferably, it is provided that the transmission arranged between the work motor and the work roller comprises a belt drive with at least two pulleys and at least one drive belt, and that the auxiliary drive can be coupled to the belt drive. In a belt drive, the auxiliary drive can be advantageously coupled in such a manner that no enlargement of the width of the construction machine is required. Notably, the auxiliary drive can be accommodated within the housing of the belt drive so that the construction machine need not have a larger width.

It can be provided that the motor-side pulley of the belt drive can be decoupled from the drive motor by means of a coupling unit. In this manner, the flux of force between the drive motor and the work roller can be reliably interrupted.

In the preferred embodiment, it is provided that the auxiliary drive can be coupled to the belt drive via a friction roller.

In this arrangement, the friction roller can be arranged to be coupled to the drum-side pulley. The use of a friction roller further offers the advantage that the torque which can be transmitted is limited. If there is a too high moment of resistance, e.g. in case of a blockade of the work drum, the friction roller will slip, thus considerably reducing the risk of accidents because no high forces can occur during the rotation of the work drum. This is of importance e.g. if pieces of clothing of the operating person get caught on the tools of the work drum while the drum is rotated.

By way of alternative, the auxiliary drive can be coupled to the at least one drive belt.

According to a further alternative, it can be provided that the auxiliary drive is coupled to the belt drive via a gear wheel. For instance, at least one drive belt of the belt drive can comprise a toothed belt engaging the gear wheel of the auxiliary drive.

In a further exemplary embodiment, the drum-side pulley can comprise a gear wheel arranged to mesh with the gear wheel of the auxiliary drive.

The belt drive preferably includes a tensioning roller which in the tensioned state of the at least one drive belt couples the drum-side pulley to the motor-side pulley, and in the released state decouples the pulleys from each other.

Even if the motor-side pulley is provided to be decoupled through a coupling unit, the auxiliary drive can be provided for coupling with a tensioning roller of the belt drive. For this purpose, the tensioning roller can simultaneously function as a friction roller of the auxiliary drive acting onto the drive belts, or the friction roller is pressed against the tensioning roller to drive the same.

In a further embodiment, a movable auxiliary drive can be coupled to the belt drive housing which is attached in a stationary manner to the machine frame, and a drive axis of the auxiliary drive can be coaxially coupled to the drum-side pulley through a recess formed in the drive belt housing. For this purpose, the pulley and the auxiliary drive and the respective parts of the housing comprise mutually adapted coupling elements.

According to a further alternative, the auxiliary drive can be arranged to be coupled to the drive side of the coupling unit which is provided for decoupling the motor-side pulley from the drive motor.

Preferably, the auxiliary drive comprises an electrically powered motor. Power can be fed to such a motor from a battery of a generator or from an additional supply unit and, when no power is supplied, the motor can be permanently coupled to the drive line in idle operation.

Alternatively, use can be made of hydraulically or pneumatically operated motors for the auxiliary drive, which also allow for idle operation when provided with a control circuit.

In a particularly preferred embodiment, the auxiliary drive is provided with a time control unit, wherein the auxiliary drive can be started via a remote control and the time control unit will determine the switch-on period of the motor. Each time the auxiliary drive is started, the work drum will be rotated by a predetermined but variably adjustable rotational angle.

Preferably, the motor of the auxiliary drive can be switched on only in the switched-off condition of the drive motor for the work drum.

Embodiments of the invention will be described in greater detail hereunder with reference to the drawings.

DESCRIPTION OF THE PREFERRED EMBODIMENTS

Figure 1:
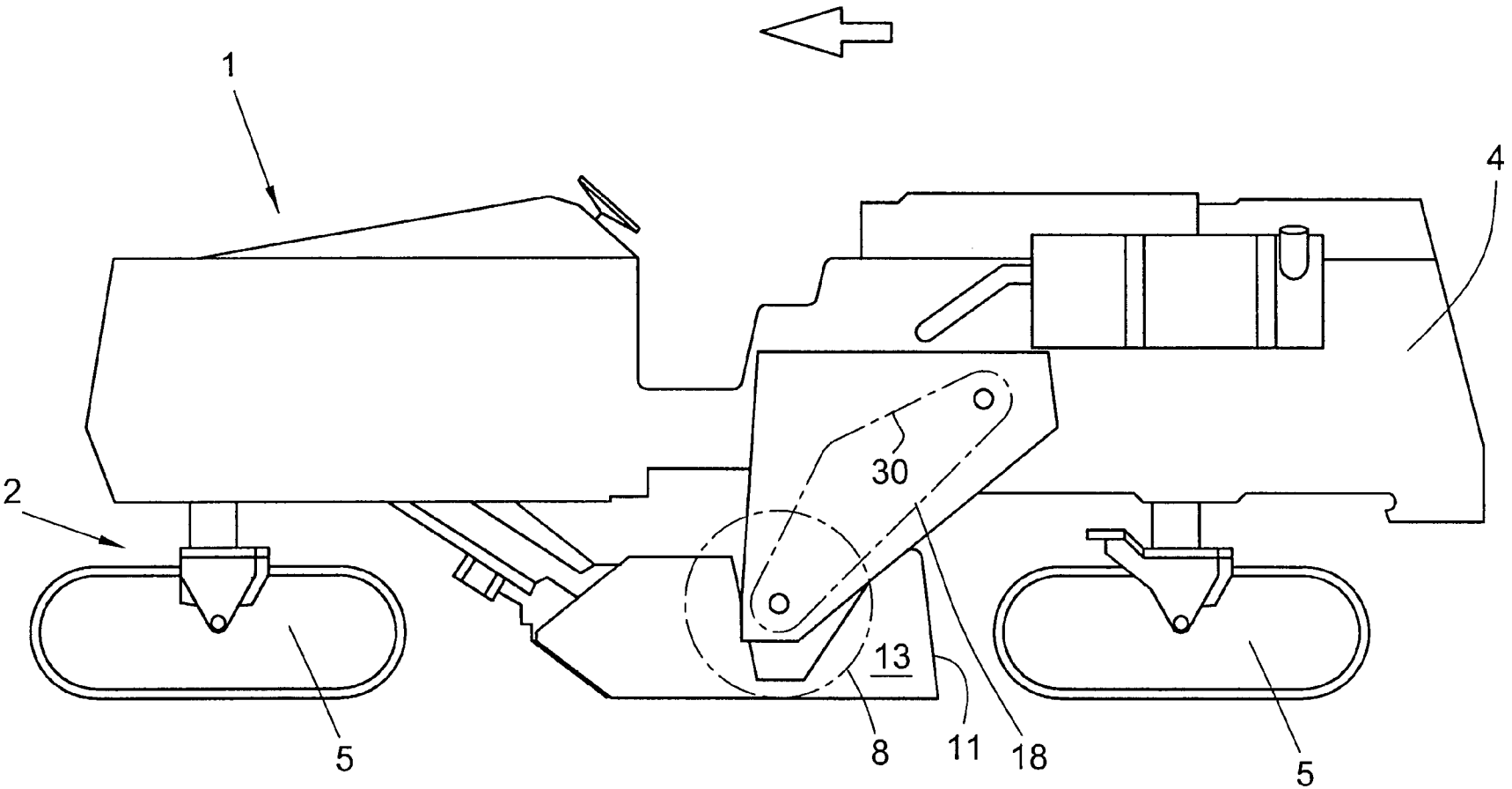
FIG. 1 is a view of a large-sized milling device with belt drive for the work drum.

The construction machine 1 illustrated in FIG. 1 is a large-sized milling device comprising a machine frame 4 supported by truck assemblies 5 of a chassis 2 which is adjustable in height. Machine frame 4 is provided with a work drum 8, arranged between the truck assemblies 5 and supported on machine frame 4, which work drum is equipped with tools 14 formed as milling bits for removing a road surface. The exchangeable tools 14 are arranged in a predetermined pattern on the outer surface 12 of work drum 8. A drive line 18 is provided to drive the work drum 8. Drive line 18 comprises at least one drive motor 6 as well as a belt drive 16 coupled to drive motor 6. Belt drive 16 comprises a motor-side pulley 28 and a drum-side pulley 24 which are coupled to each other by at least one drive belt 30. Drive belt 30 is preferably composed of V-belts.

Figure 2:
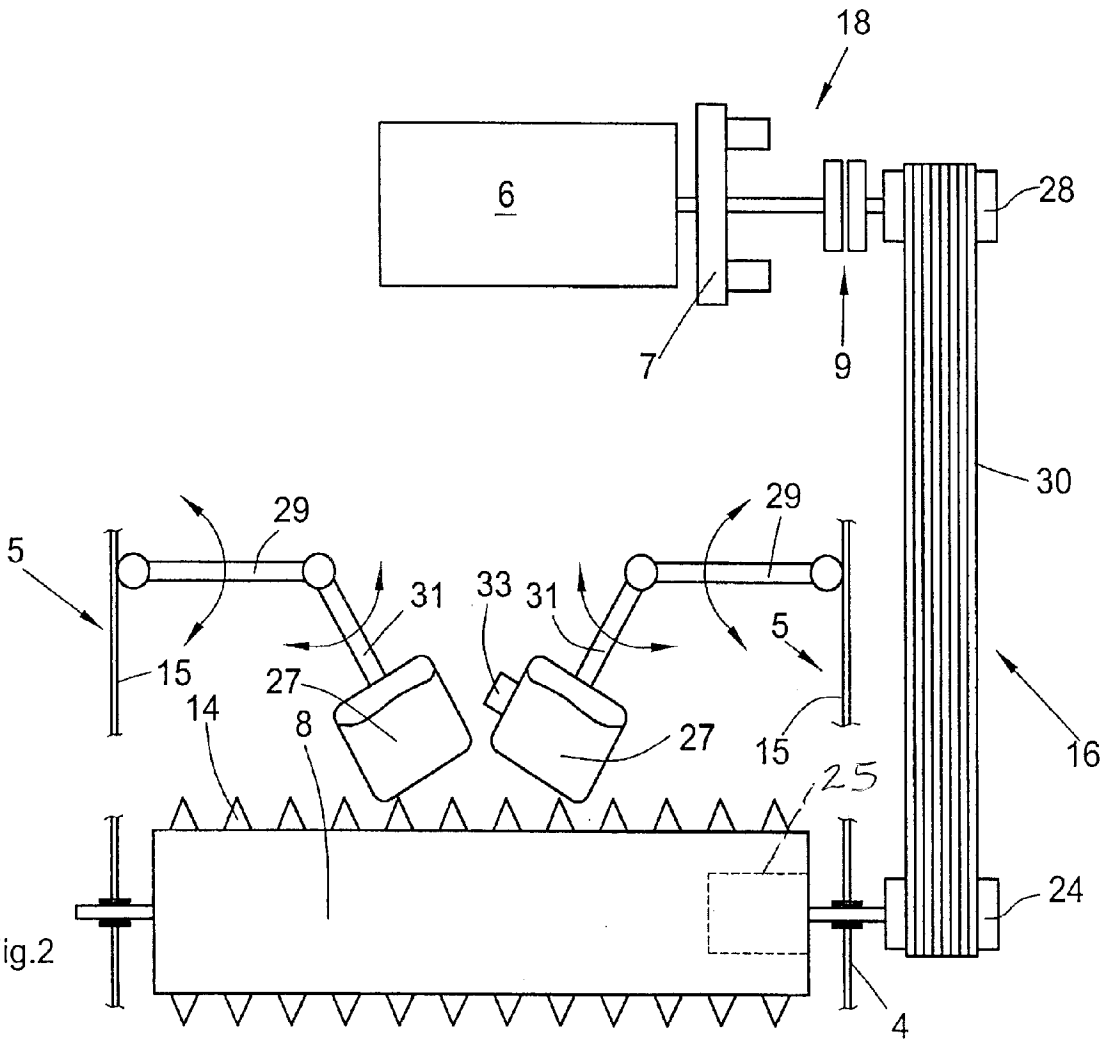
FIG. 2 is a view of the drive line for the work drum.

FIG. 2 shows the drive line comprising the drive motor 6 which can be coupled to a pump distributor drive system 7 arranged to have coupled thereto a plurality of different hydraulic drives for different functions of the construction machine.

Drive motor 6 and pump distributor drive 7 can be coupled via a coupling unit 9 to the motor-side pulley 28. Work drum 8 is supported in the walls of machine frame 4. Work drum 8 can have a reduction gear 25 arranged internally thereof which reduces the rotational speed of the drum-side pulley 24 e.g. at a ratio of 1:20. Thus, work drum 8 can work at an operational rotational speed of about 100 rpm if the internal combustion engine is operated at a rotational speed of 2000 rpm and belt drive 16 has a speed transmission ratio of 1:1.

At the end of their service life, the exchangeable tools 14 arranged on the outer surface 12 of work drum 8 must be replaced by new tools, which is performed by an operating person who, for this purpose, can open a lid 11 of the drum housing 13 to thus enter the working space behind work drum 8. On the rear truck assemblies 5 as seen in the moving direction, respectively one seat 27 is articulated for movement about vertical axes by two pivot arms 29,31 on side walls 15 of the truck assemblies 5, so that the seats 27 can be pivoted as desired in a horizontal plane.

The operating person, while positioned on one of the seats 27, can operate a remote control 33 for an auxiliary drive 20 to be coupled to the drive line 18.

In this arrangement, the work drum 8 is arranged in a raised position so that the tools 14 are out of engagement with the ground surface. By means of the auxiliary drive 20, work drum 8 can be rotated by a predetermined rotational angle so that the next row of tools 14 can be brought into a convenient mounting position.

Figure 3:
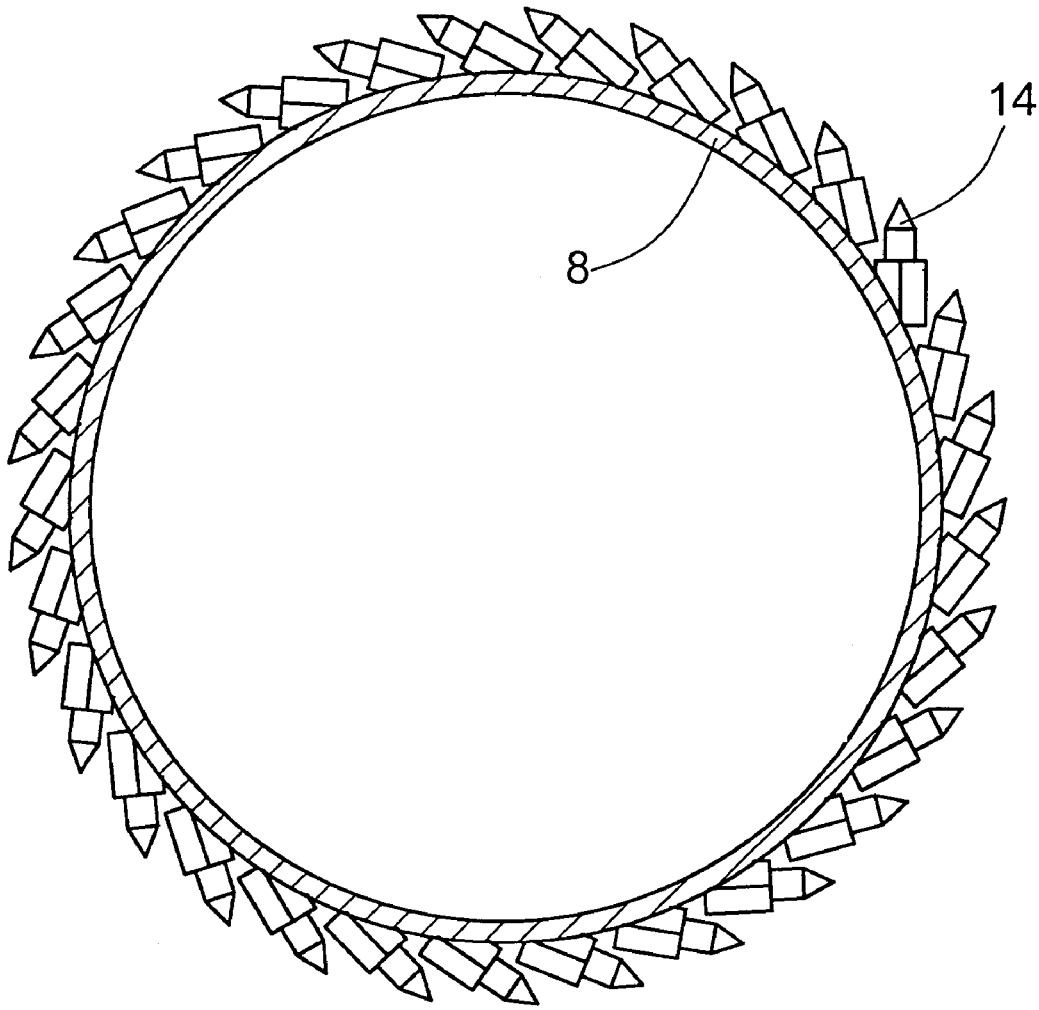
FIG. 3 is a cross-sectional view of the work drum.

The arrangement of the tools 14 on the outer surface 12 of work drum 8 is best seen in FIG. 3. Upon activation of auxiliary drive 20, work drum 8 can be rotated by a specific angular degree or for a specific length of time.

The torque of auxiliary drive 20 is higher than the moment of inertia of work drum 8 and drive line 18 in the switched-off or decoupled state of drive motor 6. In this regard, the torque should be higher only by an amount sufficient to guarantee a rotating movement of work drum 8 which will not subject the operating person to the risk of an accident. For instance, it will be sufficient if the transmitted torque is by 10 to 30% higher than the moment of inertia of the work drum 8 and the part of the work line 178 which is moved along.

Figure 4:
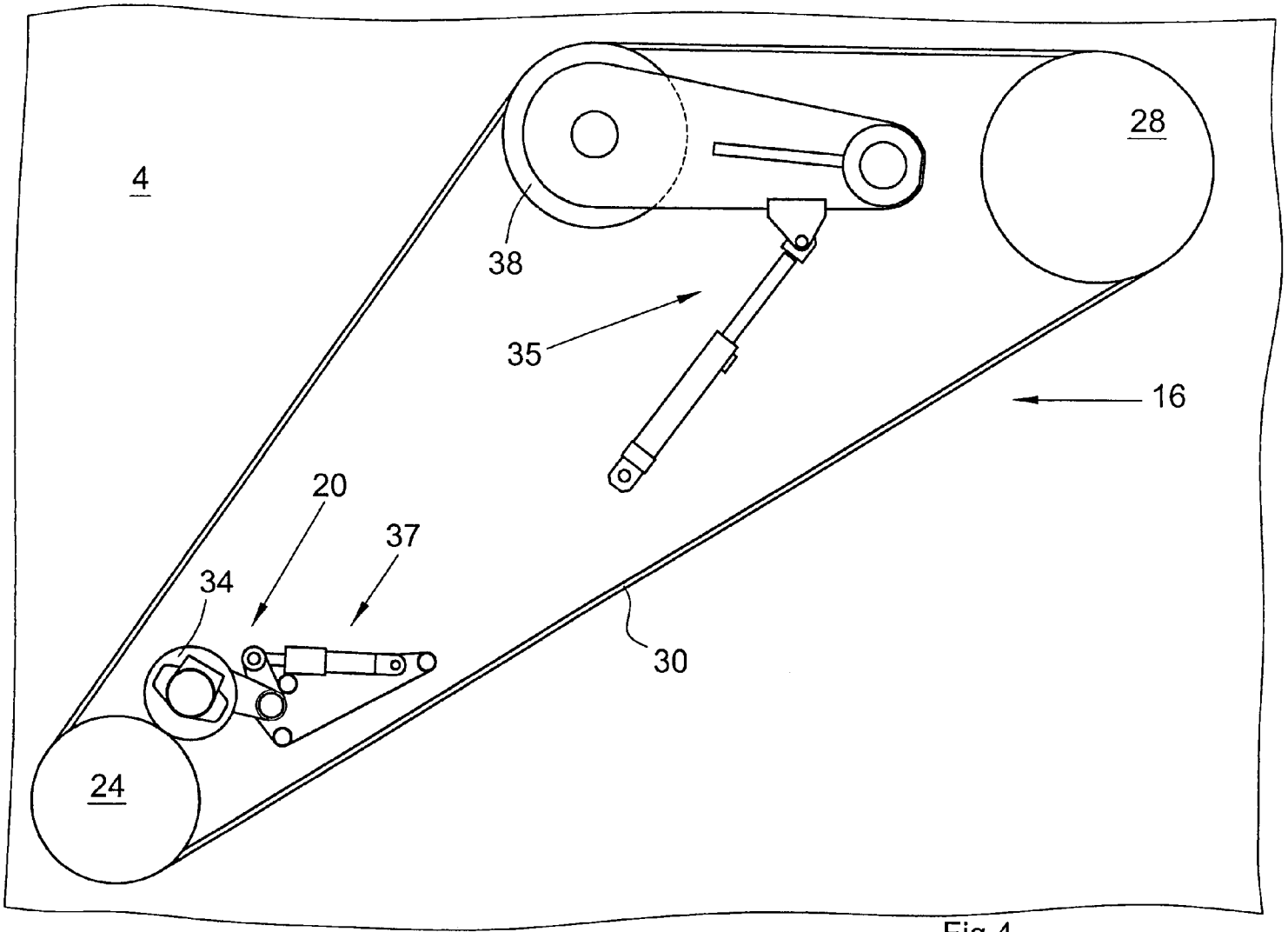
FIG. 4 is a view of a first embodiment of an auxiliary drive.

FIG. 4 shows a first embodiment of an auxiliary drive 20 designed to be coupled to the belt drive 16. As evident from FIG. 4, the drive belt 30 is arranged to circulate via the motor-side pulley 28, via a tensioning roller 38 adapted to be pressed on by a tensioning means 35, and via the drum-side pulley 24. A friction roller 34 of auxiliary drive 20 can be pressed onto the drum-side pulley 4 by an adjustment means 37, whereby the auxiliary drive 20 can transmit a torque to the drum-side pulley 24. The friction roller 34 has the advantage that the torque which can be transmitted will be limited. In case of a blockade of work drum 8, the friction roller 34 would ultimately slip on the pulley 24 so that the danger of an accident would be practically excluded.

Figure 5:
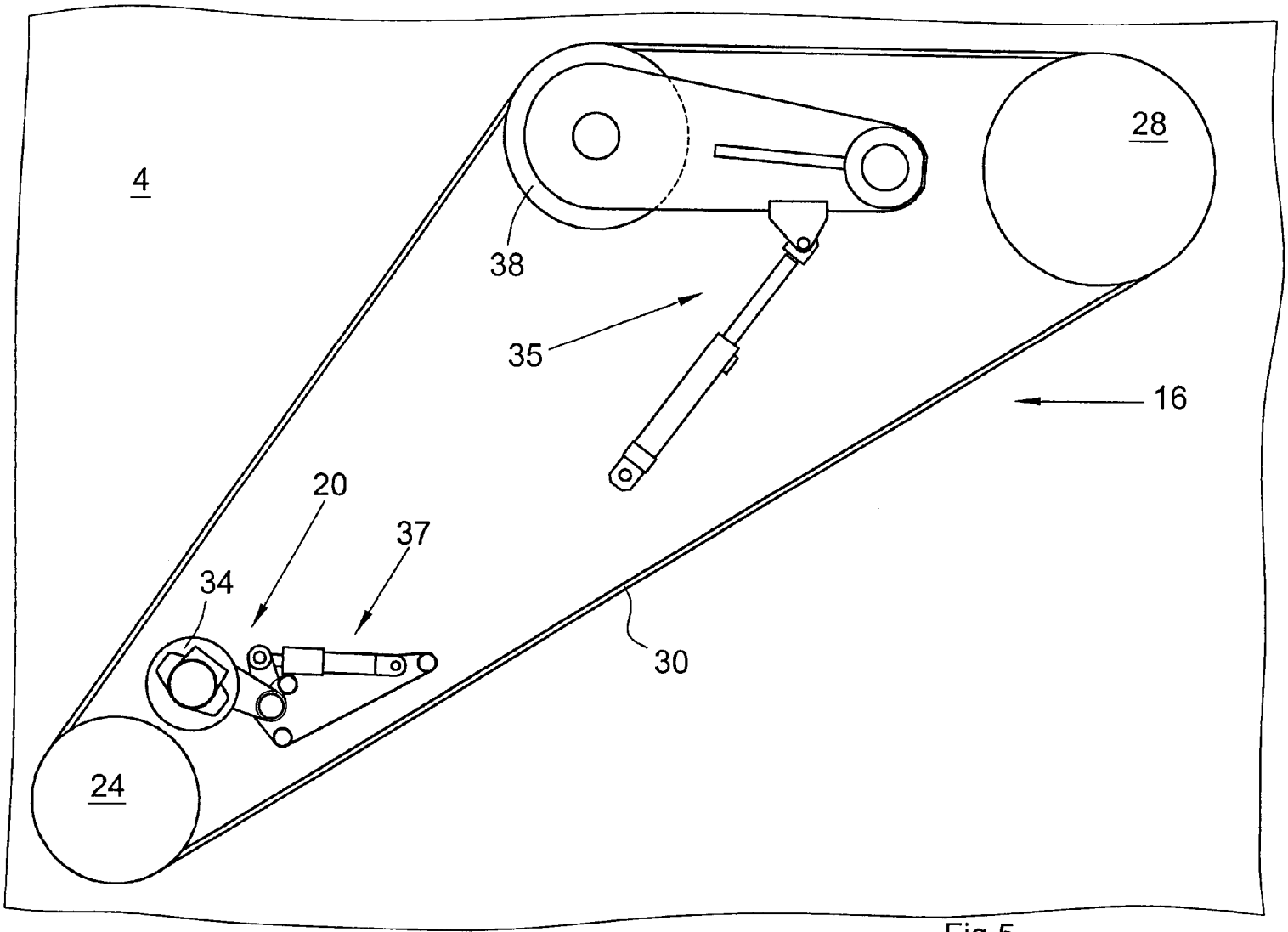
FIG. 5 is a view of the embodiment according to FIG. 4 in the decoupled state.

FIG. 5 shows the auxiliary drive 20 in a decoupled position in which the adjustment means 37, comprising a piston/cylinder unit, has moved the friction roller 34 out of engagement.

Figure 6:
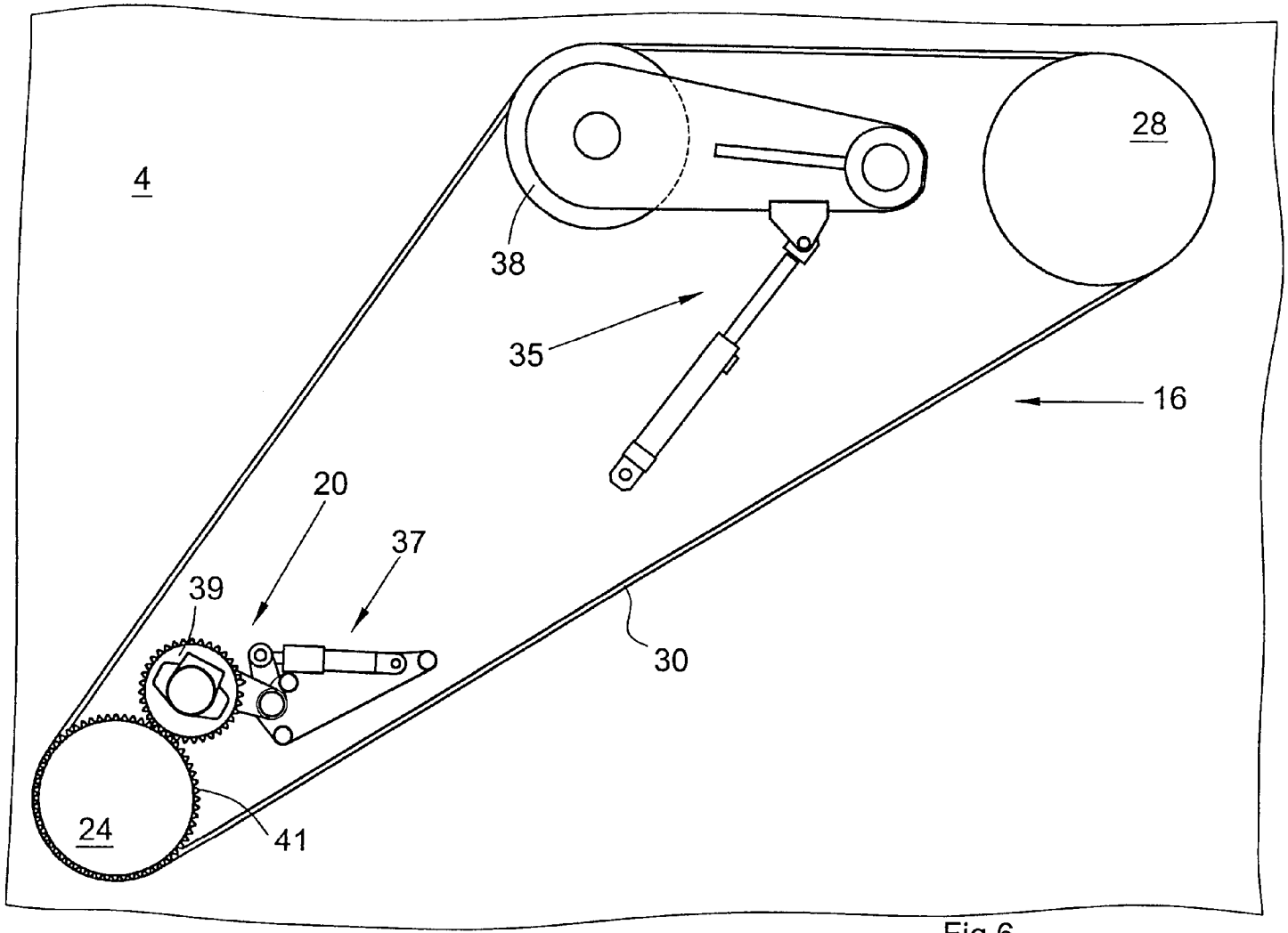
FIG. 6 is a view of a second embodiment.

FIG. 6 shows a further embodiment wherein the auxiliary drive 20 comprises a gear wheel 39 instead of the friction roller 34, which gear wheel engages an outer toothing 41 formed on the outer periphery of the pulley 24.

Figure 7:
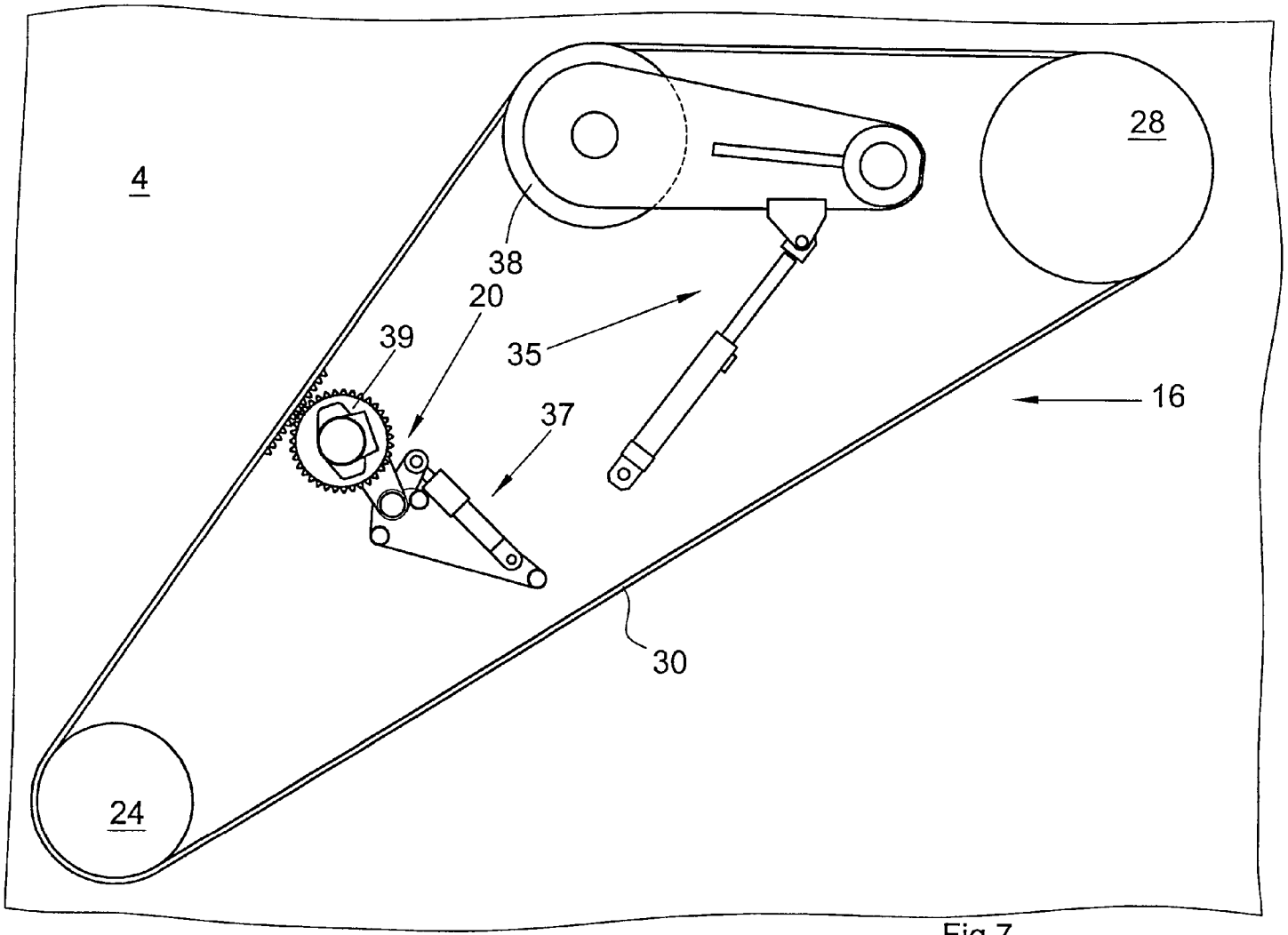
FIG. 7 is a view of a third embodiment.

Further, as shown in FIG. 7, the auxiliary drive 20 with the gear wheel 39 can be coupled directly to a toothed belt of the drive belt 30, it being sufficient then if one of the belts has a toothing formed thereon. In FIG. 7, for reasons of simplicity, the toothing of the toothed belt is shown only in the region of the gear wheel 39.

In a further embodiment, not shown in the drawing, it can be provided that the auxiliary drive is coupled to the drive side of the coupling 9 in FIG. 2.

In a further embodiment, not shown in the drawing, it can be provided that a moveable auxiliary drive 20 can be coupled to the drum-side pulley 24 coaxially to the rotational axis of pulley 24, with the pulley 24 and the auxiliary drive 20 comprising mutually adapted and coaxial coupling elements. In this arrangement, the moveable auxiliary drive can be supported on a belt drive housing enclosing the belt drive 16, which housing is suited to have the auxiliary drive detachably fastened thereon.

The motor of the auxiliary drive 20 of the above described embodiments preferably comprises an electric motor which can be powered by a generator, a battery or an additional supply unit. The electric motor has the advantage of allowing an idle operation without the need to decouple the auxiliary drive 20 from drive line 18. In this case, the adjustment means 37 can be omitted and the auxiliary drive 20 can be permanently coupled to drive line 18.

Alternatively, the auxiliary drive can comprise a hydraulic or pneumatic drive which, however, for cases that the auxiliary drive 20 is not decoupled from the drive line 18, must be provided with a control valve allowing for idle operation.

The auxiliary drive 20 is provided with a control unit which can be activated via a remote control 33 and will control the switch-on period of the motor. In this regard it is advantageously provided that, upon each activation of the auxiliary drive by a remote-control switch, the preset maximum switch-on period and thus a predetermined maximum angular rotation of the work drum 14 will be maintained.

If the actuation of the remote-control switch is stopped before the lapse of the maximum switch-on period of e.g. 4 seconds, the auxiliary drive 20 is stopped ahead of time.

Preferably, the auxiliary drive 20 is provided with a safety circuit allowing the motor of the auxiliary drive 20 to be switched on only in the switched-out condition of drive motor 6.

Further, a safety circuit can be provided for stopping the auxiliary drive 20 if a predetermined maximum moment of resistance of work drum 8 is exceeded.

The remote control 33 for the auxiliary drive is preferably located at the seat 27 for the operating person.

The remote control 33 can also be provided with a magnetic foot and thus be attached as desired on metallic parts of construction machine 1 within reach of the operating person.

What is claimed is:

1. A construction machine for the treatment of ground surfaces, comprising a chassis carrying a machine frame, a drive motor, a work drum supported on the machine frame and having exchangeable tools fastened to its outer surface, and a drive line for the work drum comprising at least the drive motor and a transmission coupled to the drive motor, characterized in that an auxiliary drive, adapted to be coupled to the drive line, is provided to rotate the work drum in the raised condition of the drum by a predetermined or selectable rotational angle, the torque of the auxiliary drive being higher than the moment of inertia of the work drum and of the part of the drive line moved along with the work drum in the switched-off or decoupled state of the drive motor, and the auxiliary drive comprises a safety circuit for switching off the auxiliary drive when a preset moment of resistance is exceeded.

2. The construction machine according to claim 1, further comprising a remote control for the auxiliary drive arranged at a seat for the operating person which is moveable across the working width of the work drum.

3. A construction machine for the treatment of ground surfaces, comprising a chassis carrying a machine frame, a drive motor, a work drum supported on the machine frame and having exchangeable tools fastened to its outer surface, and a drive line for the work drum comprising at least the drive motor and a transmission coupled to the drive motor, characterized in that an auxiliary drive, adapted to be coupled to the drive line, is provided to rotate the work drum in the raised condition of the drum by a predetermined or selectable rotational angle, the torque of the auxiliary drive being higher than the moment of inertia of the work drum and of the part of the drive line moved along with the work drum in the switched-off or decoupled state of the drive motor, and the auxiliary drive can be switched on only in the switched-off or decoupled state of the drive motor (6).

4. A construction machine for the treatment of ground surfaces, comprising:

a machine frame;

a drive motor;

a work drum supported from the machine frame and including exchangeable tools fastened to the work drum;

a belt drive including:

a motor-side pulley connected to the drive motor;

a drum-side pulley connected to the work drum;

at least one drive belt connecting the motor-side pulley to the drum- side pulley; and a belt drive housing within which the pulleys and the at least one drive belt are housed; and an auxiliary drive housed within the belt drive housing and adapted to be coupled to the belt drive so that the auxiliary drive can rotate the work drum in a raised condition of the work drum.

5. The construction machine according to claim 4, further comprising a coupling between the drive motor and the motor-side pulley, so that the motor-side pulley can be decoupled from the drive motor through the coupling.

6. The construction machine according to claim 5, wherein the auxiliary drive can be coupled to the drum-side pulley.

7. The construction machine according to claim 5, wherein the auxiliary drive can be coupled to the at least one drive belt.

.

8. The construction machine according to claim 4, wherein the auxiliary drive can be coupled to the drum-side pulley.

9. The construction machine according to claim 4, wherein the auxiliary drive can be coupled to the at least one drive belt.

10. The construction machine according to claim 4, wherein the auxiliary drive can be coupled to the belt drive through a friction roller.

11. The construction machine according to claim 4, wherein the auxiliary drive can be coupled to the drum-side pulley through a friction roller.

12. The construction machine according to claim 4, wherein the auxiliary drive is coupled to the belt drive through a first gear wheel.

13. The construction machine according to claim 12, wherein the at least one drive belt is a toothed belt engaging the gear wheel of the auxiliary drive.

14. The construction machine according to claim 12, wherein the drum-side pulley comprises a second gear wheel meshing with the first gear wheel of the auxiliary drive .

15. The construction machine according to claim 4, wherein the belt drive comprises a tensioning roller which in the tensioned state of the at least one drive belt couples the drum-side pulley to the motor-side pulley, and in the released state decouples the pulleys from each other.

16. The construction machine according to claim 4, wherein the belt drive comprises a tensioning roller and the auxiliary drive can be coupled to the at least one drive belt through the tensioning roller.

17. The construction machine according to claim 5, wherein the auxiliary drive can be coupled to the drive side of the coupling.

18. The construction machine according to claim 4, wherein the auxiliary drive comprises an electrically, hydraulically or pneumatically operated motor.

19. The construction machine according to claim 4, wherein the auxiliary drive comprises a control unit, and the auxiliary drive can be activated through a remote control control coupled to the control unit, and the control unit is arranged to control the maximum switch-on time of the motor for the auxiliary drive.

20. The construction machine according to claim 19, wherein the remote control for the auxiliary drive is arranged at a seat for the operating person which is moveable across the working width of the work drum.

21. The construction machine of claim 4, wherein:

the auxiliary drive is a moveable auxiliary drive comprising an auxiliary drive motor and a position adjusting mechanism connected between the machine frame and the auxiliary drive motor, the position adjusting mechanism being moveable between a coupled position wherein the auxiliary drive engages the belt drive and a decoupled position wherein the auxiliary drive is out of engagement with the belt drive.

22. The construction machine of claim 21, wherein the position adjusting mechanism comprises a piston/cylinder unit.

23. The construction machine of claim 4, wherein the auxiliary drive is permanently coupled to the belt drive.

24. The construction machine of claim 23, wherein the permanently coupled auxiliary drive further comprises an electric motor.

25. The construction machine of claim 23, wherein the permanently coupled auxiliary drive further comprises a hydraulic motor.

26. The construction machine of claim 25, wherein the permanently coupled auxiliary drive is coupled to the drum-side pulley.

27. The construction machine of claim 23, wherein the permanently coupled auxiliary drive further comprises a hydraulic motor provided with a control valve allowing for idle operation.

28. The construction machine of claim 23, wherein the permanently coupled auxiliary drive further comprises a pneumatic motor.

29. The construction machine of claim 23, wherein the permanently coupled auxiliary drive further comprises a pneumatic motor provided with a control valve allowing for idle operation.

30. The construction machine of claim 4, wherein the auxiliary drive is surrounded by the at least one drive belt.

31. The construction machine of claim 4, wherein the auxiliary drive comprises a safety circuit for switching off the auxiliary drive when a preset moment of resistance is reached.

32. The construction machine of claim 4, wherein the auxiliary drive can be switched on only in a switched-off or decoupled state of the drive motor.

33. The construction machine of claim 4, wherein:

the auxiliary drive is coupled to the drum-side pulley; and the auxiliary drive comprises a hydraulic motor provided with a control circuit allowing for idle operation.

34. The construction machine of claim 4, wherein:

the auxiliary drive has a torque output in the range of 10% to 30% higher than the moment of inertia of the work drum and of the part of the drive line moved along with the work drum in the switched-off or decoupled state of the drive motor.

* * * * *

UNITED STATES PATENT AND TRADEMARK OFFICE

CERTIFICATE OF CORRECTION

PATENT NO. : 7,644,994 B2
APPLICATION NO. : 10/312622
DATED : January 12, 2010
INVENTOR(S) : Busley et al.

It is certified that error appears in the above-identified patent and that said Letters Patent is hereby corrected as shown below:

Column 7, line 14, delete "control" before "coupled".

Signed and Sealed this

Sixth Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,644,994 B2
APPLICATION NO. : 10/312622
DATED : January 12, 2010
INVENTOR(S) : Busley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1688 days.

Signed and Sealed this

Sixteenth Day of November, 2010

David J. Kappos

David J. Kappos
*Director of the United States Patent and Trademark Office*